US005628255A

United States Patent [19]

Neuner

[11] Patent Number: 5,628,255

[45] Date of Patent: May 13, 1997

[54] COMPUTER CORNER DESK ASSEMBLY

[76] Inventor: Frank Neuner, 5521 Pershing Ave., Downers Grove, Ill. 60515

[21] Appl. No.: 597,098

[22] Filed: Feb. 6, 1996

[51] Int. Cl.[6] ..... A47B 47/04

[52] U.S. Cl. ..... 108/42; 108/92; 312/238; 312/223.3; 52/36.4

[58] Field of Search ..... 108/42, 92, 91, 108/901, 50; 312/196, 238, 223.3, 351; 52/36.1, 36.4; 33/12

[56] References Cited

U.S. PATENT DOCUMENTS

| | | | |
|---|---|---|---|
| D. 279,629 | 7/1985 | Musgrave . | |
| 321,037 | 6/1885 | Kinley | 312/238 |
| D. 330,124 | 10/1992 | Short . | |
| 2,036,184 | 4/1936 | Armstrong | 312/238 |
| 2,368,285 | 1/1945 | Bullard | 312/238 |
| 2,798,617 | 7/1957 | Sehreiber | 108/92 |
| 3,297,382 | 1/1967 | Snowden . | |
| 3,899,949 | 8/1975 | Bystron et al. | 33/12 |
| 4,760,800 | 8/1988 | Hanson | 108/42 |
| 4,761,921 | 8/1988 | Nelson | 52/36.1 |
| 4,936,228 | 6/1990 | Capo-Bianco . | |
| 4,951,576 | 8/1990 | Cobos et al. | 108/901 |
| 5,291,700 | 3/1994 | Chew | 52/36.4 |
| 5,373,793 | 12/1994 | Crossman | 108/42 |

*Primary Examiner*—Peter M. Cuomo
*Assistant Examiner*—Anthony D. Barfield
*Attorney, Agent, or Firm*—Howard Cohen

[57] ABSTRACT

A freestanding corner furniture unit includes a pair of side support panels extending vertically from a floor, the side supports disposed mutually orthogonally, each side support extending perpendicularly from an adjacent wall that defines a corner of a room. A plurality of shelves are disposed in a vertically stacked, spaced apart array spanning the side supports. The shelves all include a pair of laterally opposed edges disposed in orthogonal relationship and each adapted to impinge on a respective side support, whereby each shelf is secured to the side supports. All shelves include a pair of rear edges disposed in orthogonal relationship and disposed to impinge on respective adjacent wall surfaces that converge to define the corner area. The lowermost shelf projects outwardly from the corner, and is spaced from the supporting floor to define a desk surface. The shelves above the lowermost shelf are provided with dogleg configurations that decrease in plan area with increasing height, whereby the assembly presents the appearance of tapering upwardly to provide spaciousness and openness. A plurality of interior supports are disposed in paired relationship to support the medial portions of the shelves from the floor surface. In addition, the assembly may provide a reinforcing ring joined to the lower surface of the lowermost shelf and extending adjacent to the periphery thereof. All shelves include a truncation edge extending between the rear edges of each shelf to define with the adjacent wall surfaces a triangular opening. The triangular opening of all the shelves are vertically aligned to provide a cableway and a virtual flue for the convection of hot air.

18 Claims, 4 Drawing Sheets

COMPUTER CORNER DESK ASSEMBLY

BACKGROUND OF THE INVENTION

The present invention generally relates to desk furniture, and more particularly to a furniture assembly designed to be placed in a corner and to support a personal computer and associated devices.

The proliferation of personal computers in recent years has profoundly altered the conduct of office work, and has changed the focus of entertainment and family activities within many homes. Current data reveals that at least one-third of all homes in the United States are equipped with a personal computer, and the industry expects this number to double within a few years. Aside from traditional work-oriented tasks such as writing, graphics, and data processing, computers in the home are typically used for game playing, student homework, educational tasks such as keyboard training and math and spelling drills, and research on CD ROM-based data resources. In addition, the expanding interest in network connection of home computers has greatly increased the potential for in-depth research, message transmission, home shopping, and the like.

The advent of personal computers has also changed the landscape of a typical home. Video displays, alphanumeric keyboards, modems, scanners, CD ROMs, and the like now occupy many desks and work surfaces that were not designed for computer use. In particular, the typical office desk lacks the depth (front edge to back edge) to support a computer and all the peripheral devices noted above, while also providing sufficient space to establish a comfortable work area. The keyboard area is often too shallow, and the computer user is typically required to sit closer to the monitor than is desirable or optimal. Moreover, an office desk is usually too large and obtrusive for comfortable use in a home environment.

Given the fact that most homes are replete with furniture used for non-computer functions, the addition of a computer and its peripheral devices may comprise a burden on existing furnishings. It is generally true that many corner areas in a home are not well utilized. Corners often become the repositories of objects, such as audio speakers or bookshelves, that must be placed out of the way of interior traffic patterns. Corner areas could be exploited beneficially for computer installations, particularly in view of the fact that corners are "quiet areas" that are naturally isolated from noise and interference.

However, standard office desk designs are not well adapted for use in a corner area. Desks that have sufficient horizontal space for a computer and the usual peripheral devices may not fit in a corner area, whereas a desk that fits into a corner may be too small for computer use. Moreover, corner areas generally include a large vertical space that is not well served by a standard desk design. Thus there exists in the prior art an unmet need for a furniture unit that is adapted to fit into a corner area and that includes sufficient lateral surface area to support a computer and related devices in an arrangement that is ergonomic and inviting.

SUMMARY OF THE INVENTION

The present invention generally comprises a freestanding furniture unit that is designed to fit into a typical corner area and to support a computer and its peripheral devices. The furniture unit is designed to take advantage of the vertical space in a corner area, thereby providing a large amount of horizontal surface area in a small "footprint" area in a corner.

In one aspect, the invention includes a pair of side supports extending vertically from a floor surface, the side supports each comprising a panel disposed orthogonally to the other, each side support extending perpendicularly from an adjacent wall that defines a corner of a room. A plurality of shelves are disposed in a vertically stacked, spaced apart array between the side supports. The shelves all include a pair of laterally opposed edges disposed in orthogonal relationship and each adapted to impinge on a respective side support, whereby each shelf is secured to the side supports and disposed to span the distance therebetween.

Furthermore, all of the shelves are provided with a pair of rear edges disposed in orthogonal relationship and disposed to impinge on respective adjacent wall surfaces that converge to define the corner area. Thus the wall surfaces serve as the rear confining surfaces for the furniture unit. The lowermost shelf projects outwardly from the corner, and is spaced from the supporting floor to define a desk surface. The shelves above the lowermost shelf are provided with dogleg configurations that decrease in plan area with increasing height, whereby the assembly presents the appearance of tapering upwardly to provide spaciousness and openness.

The assembly further includes a plurality of interior supports disposed in paired relationship to support the medial portions of the shelves from the floor surface. The interior supports comprise vertically extending panels disposed in vertically stacked relationship, and are disposed interstitially between the floor and the lowermost shelf, and well as between all of the shelves. In addition, the assembly may provide a reinforcing ring joined to the lower surface of the lowermost shelf and extending adjacent to the periphery thereof.

In a further aspect of the invention, the shelves are all provided with a truncation edge extending between the rear edges of each shelf to define with the adjacent wall surfaces a triangular opening. The triangular opening of all the shelves are vertically aligned to provide a cableway for connections between a computer and its associated peripheral devices. Moreover, the aligned openings provide a virtual flue for the convection and release of hot air generated by the operation of the computer and peripheral devices.

For an individual seated at the front edge of the lowermost shelf and engaged in interactive operation of a computer display supported thereon, the furniture assembly of the invention provides a semi-enclosed space defined by the side supports and the shelves. The individual's visual axis is generally aligned with the corner vertex of the room, creating a feeling of depth and expansiveness. Moreover, the orthogonally related side supports provide a sturdy and rigid structure with a minimum of material, so that the furniture unit conveys a visual appearance that is open and light, despite the fact that it provides a great deal of work and storage space in a small corner footprint.

In another aspect of the invention, the furniture unit is designed so that all structural members and shelf members may be laid out and cut from three sheets of standard construction material, such as 4'×8' sheets of plywood, acrylic plastic, or the like. Thus the furniture unit may be sold as a complete, assembled unit, or as a knock-down package of components for assembly by the end user, or as a set of templates to be employed by the end user to cut the components from the sheets of construction material and assemble the final product.

DESCRIPTION OF THE PREFERRED EMBODIMENT

The present invention generally comprises a freestanding desk and shelf furniture assembly that is designed to fit into a corner area of a room. Although it is described herein with reference to use in supporting a computer and its associated peripheral devices, it may be appreciated that the assembly may be used as a general purpose desk, as a cabinet for audio and video equipment, a display case, or the like.

Figure 1:
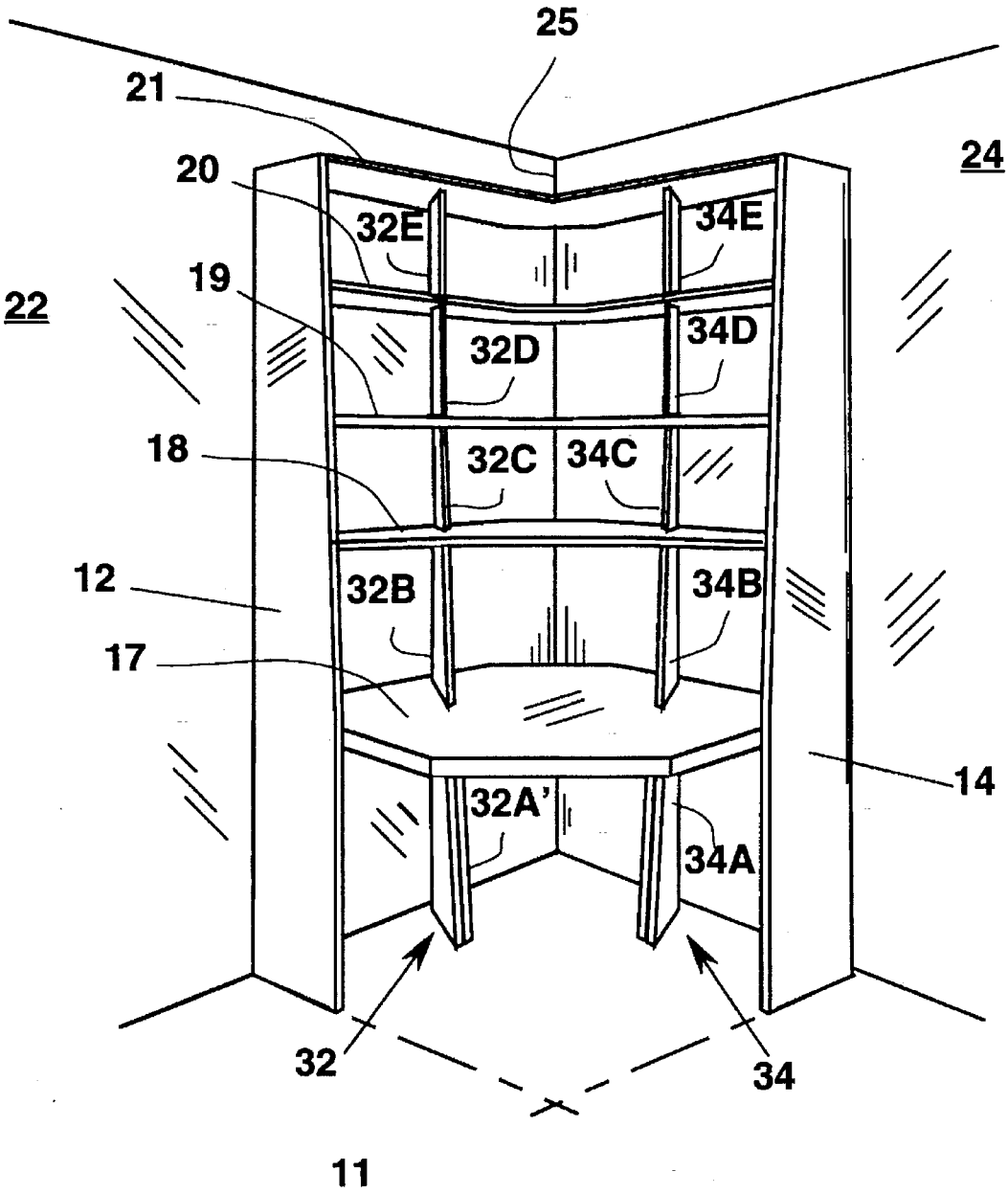
FIG. 1 is a perspective view of the corner desk assembly of the present invention.
Figure 2:
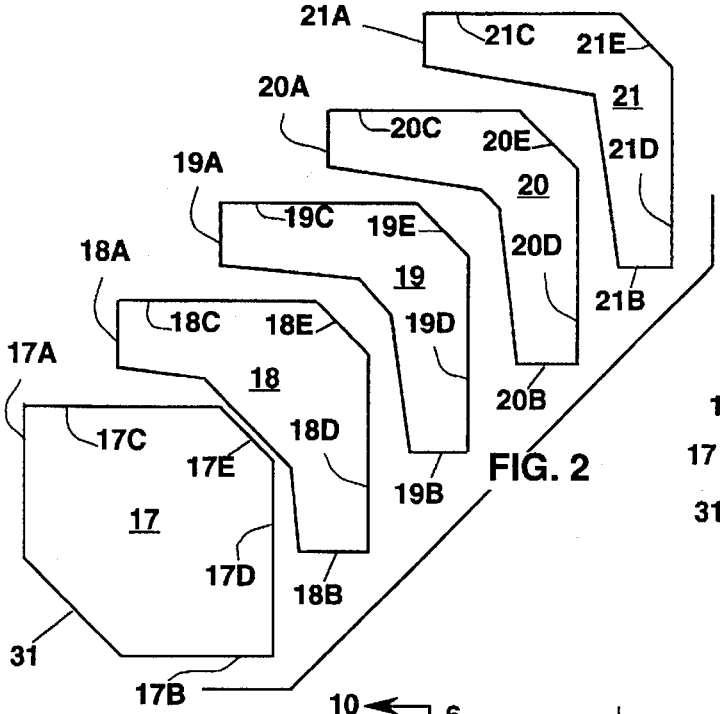
FIG. 2 is an exploded view of the shelf panels of the corner desk assembly shown in FIG. 1.
Figure 3:
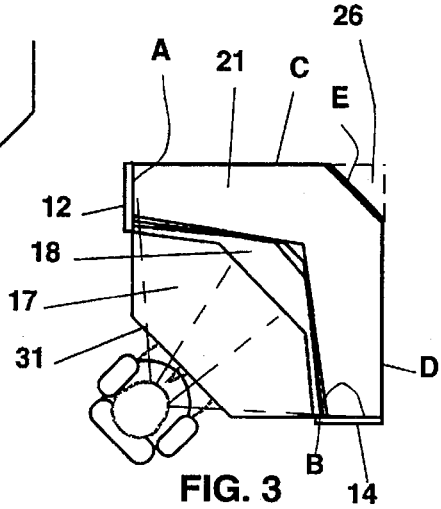
FIG. 3 is a top view of the corner desk assembly shown in FIG. 1.
Figure 4:
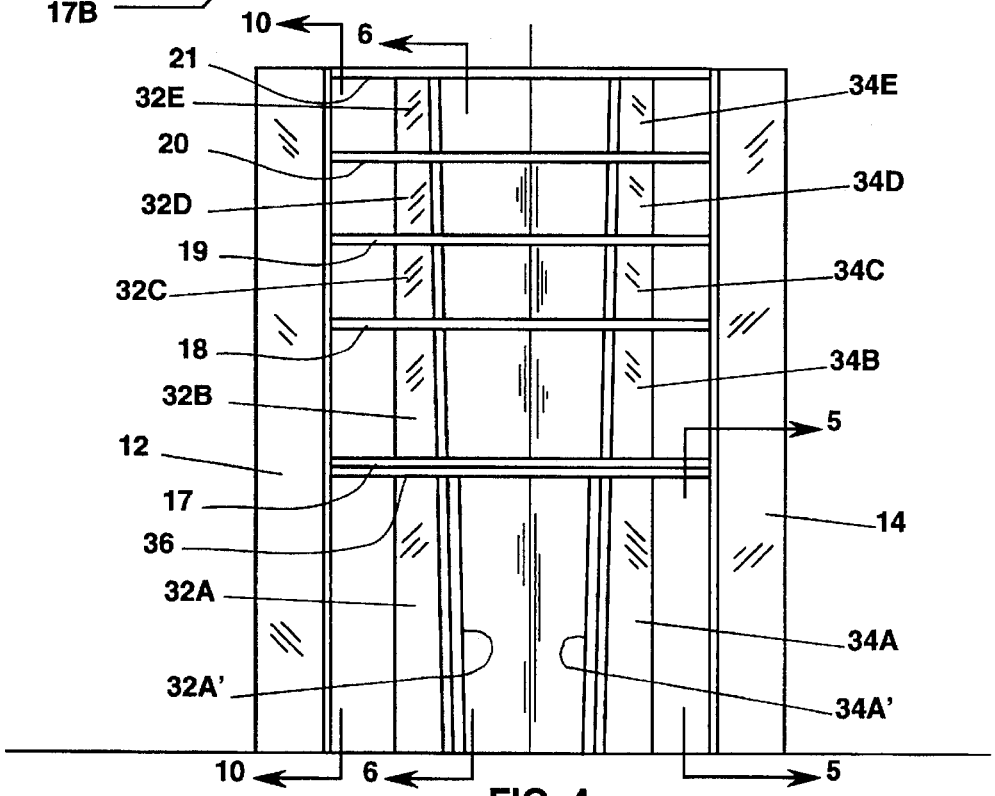
FIG. 4 is a front elevation of the corner desk assembly shown in FIGS. 1 and 3.
Figure 9:
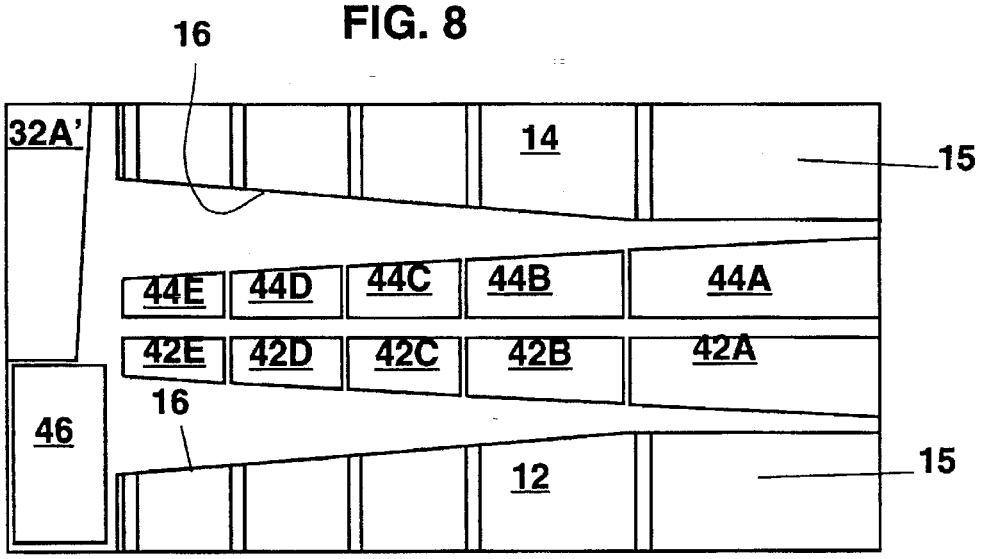
FIG. 9 is a plan view of a third template for forming some components of corner desk assembly from a standard sheet of construction material.

With reference to FIGS. 1–4, the desk and shelf assembly 11 includes a pair of side supports 12 and 14, the side supports each comprising a vertically extending panel that is disposed orthogonally to the other. Each side support includes a generally rectangular lower portion 15 and an upper portion 16 having a tapered width, as shown in FIG. 9. The assembly further includes a plurality of shelves 17–21, the shelves comprising horizontal panels having some common characteristics. In particular, each shelf includes laterally opposed side edges A and B disposed in orthogonal relationship, so that shelf 17 has orthogonal side edges 17A and 17B, shelf 18 has orthogonal side edges 18A and 18B, and so on. The shelves are disposed in vertically stacked relationship with the side edges A and B of vertically adjacent shelves in respective vertical alignment. The side edges A and B are thus disposed to impinge on and be secured to respective side supports 12 and 14, as shown in FIG. 3.

Another common characteristic of all of the shelves 17–21 is the provision of a pair of rear edges C and D, 17C and 17D, 18C and 18D, and so on, also disposed in orthogonal relationship to each other and to the adjacent edges A and B. The edges C and D of all the vertically stacked shelves are also disposed in respective vertical alignment. The edges C and D of the shelves are thus disposed to impinge on the converging wall surfaces 22 and 24 that form a corner 25 of a room. Thus the wall surfaces serve as the rear confining surfaces for the furniture unit.

In addition, all of the shelves are provided with a truncated rear edge E (17E, 18E, etc.) that truncates the convergence of sides C and D and defines a triangular opening 26 with the corner wall apex 25. The aligned openings 26 of all the shelves define a vertical passageway extending the height of the furniture unit 11. The openings 26 provide a cableway for wires required to connect computers and peripheral equipment, audio or video devices, lamps, appliances or the like supported on the shelves 17–21. In addition, the aligned openings 26 define a virtual flue for the convection and release of heated air generated by the operation of the computer and peripheral devices or other electrical devices or appliances.

Although the shelves 17–21 all bear similar edges A–E, the shelves all differ in plan layout, as shown in FIG. 2. The shelf panel 17 extends outwardly from the corner 25 to serve as a desktop or work surface, the edges 17A and 17B being significantly longer that the corresponding A and B edges of the other shelves. The convergence of edges 17A and 17B is truncated by front edge 31, which accommodates an individual seated thereat to use the desk and the objects on the upper shelves. The upper shelves 18–21 are provided with dogleg configurations that are increasingly narrow with increasing height in the vertical stacking order of the shelves, as is shown in FIG. 2.

Figure 5:
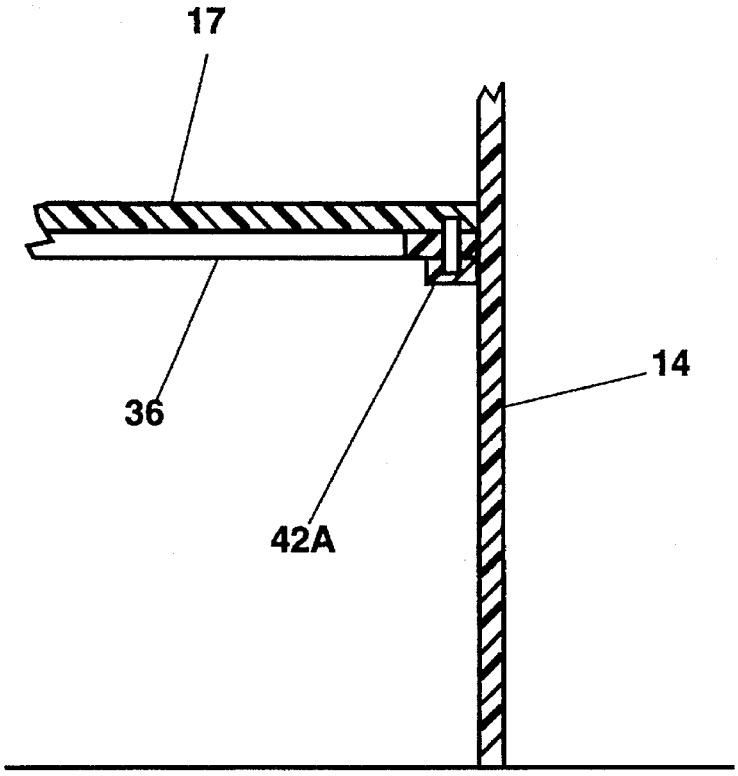
FIG. 5 is an magnified cross-sectional elevation of the desktop shelf support assembly, taken along line 5—5 of FIG. 4.
Figure 6:
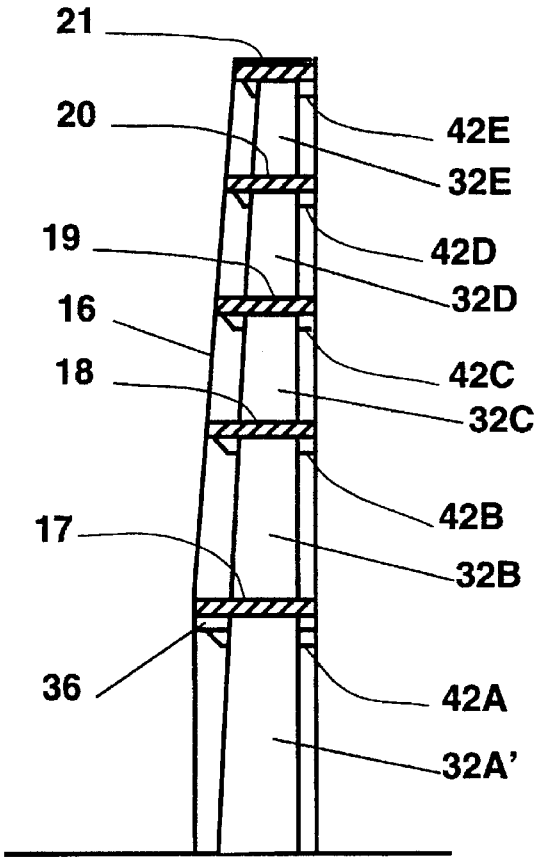
FIG. 6 is a cross-sectional elevation of the corner desk assembly, taken along line 6—6 of FIG. 4.

The assembly further includes interior support for the medial portions of the shelves. With regard to FIGS. 4 and 5, a plurality of interior support panels A–E are disposed to extend interstitially between the shelves 18–21 and between shelf 17 and the floor in paired, vertically aligned relationships 32A–32E and 34A–34E to define a pair of interior vertical support columns 32 and 34. The support panels A–E include a common front edge that tapers upwardly, as shown in FIGS. 6 and 9, whereby the panels A–E diminish in depth with increase height in the vertical stacking order. Thus columns 32 and 34 taper upwardly. All of the panels A–E of both columns 32 and 34 are disposed in parallel planes that are generally perpendicular to the front edge 31 of the desktop shelf 17.

It may be appreciated that the orthogonally related side supports provide a sturdy and rigid support of the opposed ends of the shelves with a minimum of material, and the interior supports 32A–32E and 34A–34E support loads placed on the shelves by transferring these loads directly to the floor. To accommodate the accumulated loads of all the shelves and the desktop, the lowermost panels A of the columns 32 and 34 may be augmented by the provision of additional supports 32A' and 34A'. These latter supports are secured (e.g., glued or laminated) to respective supports 32A and 34A to double the thickness and substantially strengthen the assembly.

The assembly is designed to accommodate an individual seated at the front edge 31, and the height of the desktop shelf 17 is sufficient for the seated individual to extend legs and feet beneath the shelf 17. The head of the individual is thus disposed close to the intersection of the planes of the side supports 12 and 14, as depicted in FIG. 3. The sight lines at the periphery of the field of view are defined by the planes of the side supports, and these sight lines do not converge. Thus, paradoxically, the corner space into which the user is looking has an unconfined, expansive appearance. The tapered upper portions of the side supports enhance this impression. In addition, the interior support panels are disposed perpendicularly to the front edge 31, and are generally parallel to the sight lines of the individual looking into the corner 25. The interior support panels are viewed edge-on, thus minimizing their visual impact and augmenting the openness of the interior space.

Figure 8:
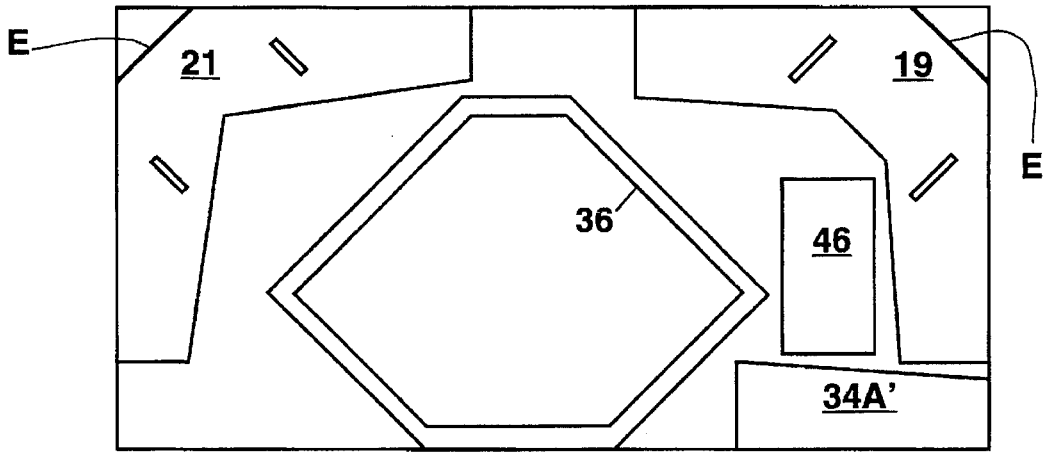
FIG. 8 is a plan view of a second template for forming some components of corner desk assembly from a standard sheet of construction material.

The assembly may further include a peripheral reinforcement ring 36, shown in FIG. 8. The shelf 17 and the ring 36 are provided with an identical peripheral configuration. The ring 34 may be laminated to the lower surface of the shelf 17 to double the edge thickness of the edge of the shelf 17, as well as to strengthen the edge and reinforce the shelf.

Figure 7:
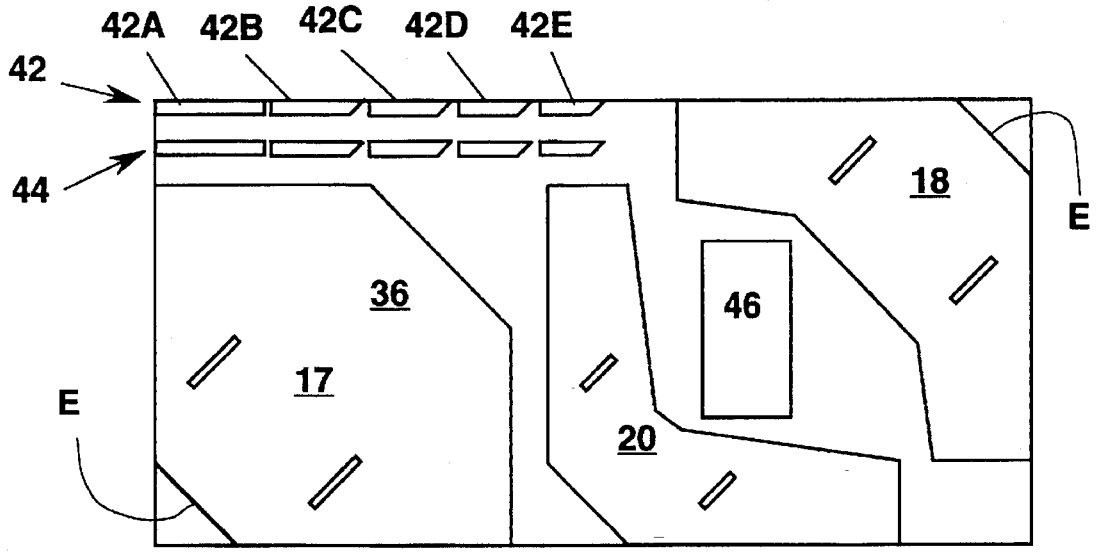
FIG. 7 is a plan view of a first template for forming some components of corner desk assembly from a standard sheet of construction material.
Figure 10:
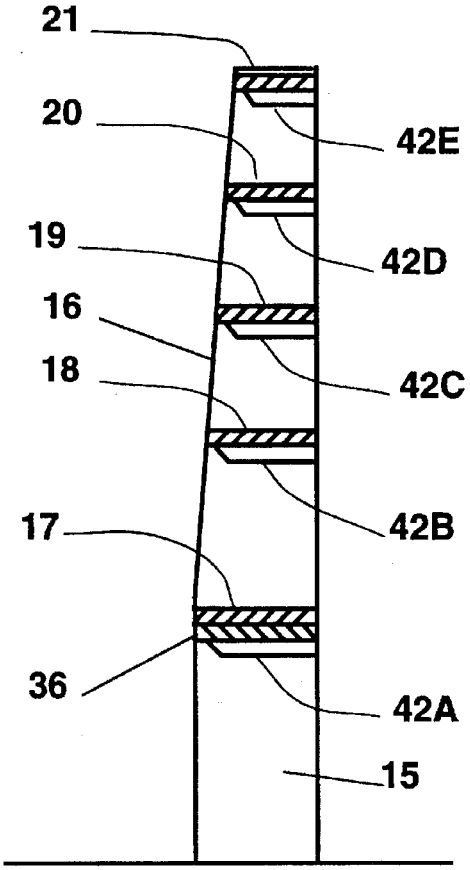
FIG. 10 is a cross-sectional elevation of the corner desk assembly, taken along line 10—10 of FIG. 4.

The opposed edges A and B of all the shelves may be secured to the respective side supports 12 and 14 by any joining means known in the woodworking art, such as screws, nails, brackets, hangars, adhesive, dowel pins, or any combination thereof. For example, the preferred embodiment provides a plurality of cleats 42A–42E and 44A–44E to secure the shelves to the side supports, as shown in FIGS. 6, 7 and 10. Each cleat 42A–42E and 44A–44E is configured to be secured to the respective side support 12 or 14 beneath the respective edges A or B of the shelves 17–21. (The shelf 17 rests on the reinforcing ring 36, which in turn is supported on the cleats 42A and 44A.) Each cleat is provided with a length that is less that the width of the shelf it supports, so that the forward edge is recessed from the front edge of each shelf. Moreover, the forward edge of each cleat is beveled to taper downwardly and inwardly from the front edge of the respective shelf, to soften the appearance of the cleats. The cleats may be secured to the side supports by the means noted above, and each shelf is secured to its respective cleats by any of the same means. The shelves may be made removable from the side supports, and likewise the interior supports, so that the entire assembly may be taken apart, transported, and reconstructed with a minimum of labor.

The furniture unit may be sold as a complete, assembled unit, or as a knockdown package of components for assembly by the end user. Furthermore, invention may be commercialized as a set of templates to be employed by the end user to cut the components from the sheets of construction material and assemble the final product. These full scale templates are to be positioned over three sheets of four foot by eight foot, three-quarter inch thickness of plywood or other suitable building material; i.e.: acrylic, plastic, laminated glass, metal etc. and cut-out or relieved from the material. Thus the end user does not need to measure or lay out angles to cut or construct the assembly 11. This approach allows an end user the maximum versatility in selecting his or her own grade building material, and finishing it in a manner that is congruent to their existing decor. They can realize a significant cost saving by purchasing their own material, cutting and assembling the pieces and finishing; (i.e.. paint, stain, fabric, tile, etc.) to their own taste.

The templates includes the outlines of all of the components required to construct the desk and shelf assembly 11, as well as portions 46 that include printed instructions for cutting and assembling the components. The component layouts also include outlines that represent the proper placement of the cleats on the side supports and the placement of the interior supports on the shelves 17–21.

It may be appreciated that the furniture unit of the present invention occupies only a small footprint in the floor area of a room, yet provides an exceptional amount of lateral surface area for desk work, computer support, and the like. The furniture unit makes optimal use of the vertical corner space that often goes unused in a typical home arrangements. Thus it facilitates the addition of a computer facility to a typical room, without having the computer devices spread out and dominating the room. This it also true of audio or video equipment which may be supported on the furniture unit 11.

The layout of the furniture unit 11 is designed to direct the attention of the user into the corner 25, which is a space free of distractions by ambient factors. Thus the unit 11 creates a "quiet corner" environment that is optimal for focusing attention to a task, and is well-suited for studying; e.g., as a study corner in a child's bedroom.

What is claimed is:

1. A freestanding desk assembly having a front portion and a rear portion, including:

a pair of side support panels extending generally vertically and spaced apart in mutually orthogonal relationship and defining a front opening;

said pair of side support panels disposed in respective first and second planes, said first and second planes converging to intersect adjacent to the front opening of said freestanding desk assembly a plurality of shelf panels disposed in vertically stacked, spaced apart relationship, all of said shelf panels including a first pair of laterally opposed side edges disposed to impinge on said side support panels in flush relationship, said shelf panels spanning the distance between said side support panels;

means for securing said plurality of shelf panels to said side support panels; and, said plurality of shelf panels including a desktop, comprising the lowermost shelf panel.

2. The freestanding desk assembly of claim 1, wherein all of said shelf panels include a second pair of rear edges, said rear edges defining the rear portion of said freestanding desk assembly.

3. The freestanding desk assembly of claim 2, wherein all of said shelf panels include a rear truncated edge extending between said second pair of rear edges, said truncated edge defining an opening when said desk assembly is adapted to be placed in a corner defined by converging wall surfaces, the openings of said plurality of shelf panels disposed in vertically aligned relationship as a cableway and virtual flue for hot air convection.

4. The freestanding desk assembly of claim 1, wherein said desk assembly is configured to be received in a corner defined by two converging wall surfaces, and each side support panel is disposed generally orthogonally to the adjacent wall surface.

5. The freestanding desk assembly of claim 1, further including interior support means for supporting said plurality of shelf panels medially of said pair of side supports.

6. The freestanding desk assembly of claim 5, wherein said interior support means includes a pair of interior column assemblies extending vertically and disposed in laterally spaced relationship.

7. The freestanding desk assembly of claim 6, wherein each of said interior column assemblies includes a plurality of interior support panels disposed generally vertically and secured interstitially between vertically adjacent shelves and between the lowermost of said plurality of shelves and a floor surface.

8. The freestanding desk assembly of claim 7, wherein said interior support panels of said pair of interior column assemblies are disposed in nonparallel relationship to said side supports.

9. The freestanding desk assembly of claim 8, wherein said interior support panels of each interior column assembly are parallel to the interior support panels of the other interior column assembly.

10. The freestanding desk assembly of claim 1, further including means for reinforcing at least a portion of an edge of said lowermost shelf panel.

11. The freestanding desk assembly of claim 10, wherein said means for reinforcing includes a ring formed of a planar member and having a perimetrical configuration matching the perimetrical configuration of said lowermost shelf panel, said ring being laminated in planar parallel relationship to the bottom surface of said lowermost shelf panel.

12. The freestanding desk assembly of claim 1, wherein said means for securing includes a plurality of cleats, each adapted to be secured at a preselected position on one of said side supports and to be secured to an end of a preselected one of said plurality of shelf panels.

13. The freestanding desk assembly of claim 1, wherein said plurality of shelf panels above said desktop are each provided with a general dogleg configuration.

14. The freestanding desk assembly of claim 13, wherein said plurality of shelf panels above said desktop diminish in width, measured from said front opening to said rear portion, with increasing height in said vertically stacked relationship.

15. The freestanding desk assembly of claim 14, wherein said desk assembly is configured to be received in a corner defined by two converging walls, and said plurality of shelf panels includes rear edges disposed to impinge flush on the walls forming the corner, and wherein said desktop includes converging front edges projecting outwardly from the corner.

16. The freestanding desk assembly of claim 15, further including a front truncation edge joining said converging front edges of said desktop.

17. The freestanding desk assembly of claim 1, wherein each of said side support panels include a lower, generally rectangular portion extending below said desktop, and an upper portion extending above said desktop that tapers and diminishes in width toward an upper extent of said side support panels.

18. A freestanding desk assembly adapted for use in a corner defined by two orthogonal, converging wall surfaces, including:

a pair of side support panels extending generally vertically and spaced apart in mutually orthogonal relationship and defining a front opening;

a plurality of shelf panels disposed in vertically stacked, spaced apart relationship, all of said shelf panels including a first pair of laterally opposed side edges disposed to impinge on said side supports in flush relationship, said shelf panels spanning the distance between said side supports;

said plurality of shelf panels including a desktop, comprising the lowermost shelf panel;

a pair of interior column assemblies extending vertically and disposed in laterally spaced relationship; each of said interior column assemblies including a plurality of interior support panels disposed generally vertically and secured interstitially between vertically adjacent shelves and between the lowermost of said plurality of shelves and a floor surface;

a ring formed of a planar member and having a perimetrical configuration matching the perimetrical configuration of said lowermost shelf panel, said ring being laminated to a bottom surface of said lowermost shelf panel;

a plurality of cleats, each adapted to be secured at a preselected position on one of said side supports and to be secured to an end of a preselected one of said plurality of shelf panels.

* * * * *